United States Patent [19]

Dojyo et al.

[11] 3,982,356

[45]*Sept. 28, 1976

[54] HONING MACHINE FOR FINISHING TROCHOIDAL BORE OF ROTOR HOUSING OF ROTARY ENGINE

[75] Inventors: Satoshi Dojyo; Tsutomu Yoshino, both of Hiroshima, Japan

[73] Assignee: Toyo Kogyo Co., Ltd., Japan

[ * ] Notice: The portion of the term of this patent subsequent to June 11, 1991, has been disclaimed.

[22] Filed: Sept. 24, 1974

[21] Appl. No.: 508,901

Related U.S. Application Data

[63] Continuation of Ser. No. 319,000, Dec. 27, 1972, Pat. No. 3,851,422.

[52] U.S. Cl. ..... 51/34 J; 51/50 R; 51/DIG. 32

[51] Int. Cl.[2] ..... E24B 19/08

[58] Field of Search ..... 51/50 R, 50 PC, 34 H, 51/34 J, 353, 349, DIG. 32

[56] References Cited

UNITED STATES PATENTS

| | | | |
|---|---|---|---|
| 1,412,867 | 4/1922 | Hill | 51/88 |
| 2,263,878 | 11/1941 | Johnson | 51/34 J |
| 2,813,383 | 11/1957 | La Jeunesse | 51/349 |
| 2,836,936 | 6/1958 | Lovely | 51/50 R |

FOREIGN PATENTS OR APPLICATIONS

| | | | |
|---|---|---|---|
| 957,922 | 1964 | United Kingdom | 51/DIG. 32 |

*Primary Examiner*—Al Lawrence Smith
*Assistant Examiner*—Robert C. Watson
*Attorney, Agent, or Firm*—Stevens, Davis, Miller & Mosher

[57] ABSTRACT

A honing machine for finishing a trochoidal bore of a rotor housing of a rotary engine. The honing machine includes a honing head and a machine table both of which are driven by a common drive shaft separately from each other in the same direction but with an eccentricity from each other. The eccentricity is adjustable so as to make the honing head follow smoothly and finely the trochoidal inner surface. A clearance control device is also provided in the honing machine, which controls the clearance between the gears intermeshing with each other for transmitting rotation from the drive shaft to the honing head and machine table. A bias pressure control mechanism is also provided which can control the bias pressure of the honing elements of the head against the trochoidal inner periphery in response to the angular positions of the elements relative to the inner periphery. The honing machine may also include a damping device to pneumatically damp or absorb such a shock, if any, as is experienced at the contact interface between the inner periphery and the honing elements.

6 Claims, 8 Drawing Figures

HONING MACHINE FOR FINISHING TROCHOIDAL BORE OF ROTOR HOUSING OF ROTARY ENGINE

This is a continuation of application Ser. No. 319,000, filed Dec. 27, 1972, now U.S. Pat. No. 3,851,422 issued Dec. 3, 1974.

The present invention relates generally to improvements in a finishing machine, and, more particularly, to a honing machine for finishing a trochoidal bore of a workpiece by honing the inner wall surface thereof.

One of the prototype honing machines for finishing a trochoidal inner surface of a workpiece is disclosed in Japanese Patent Publication No. 6436/1965. According to this patent, the honing machine is intended to finish the two-lobed trochoidal surface of a workpiece such as a rotor housing of a rotary engine. In the honing machine, a honing head of generally triangular form is provided at its apexes with stone slips, and is received within the trochoidal bore of the rotor housing in a manner to bring the stone slips into sliding contact with the inner periphery of the trochoidal bore. In order to smoothly follow the periphery, the honing head is provided with an internal gear which meshes with a stationary outer gear disposed in a coaxial relationship with the trochoidal bore. In this instance, the tooth ratio of the stationary outer gear to the internal gear of the honing head is usually preset at a value of 2:3. A crank mechanism is also provided which has its axis arranged concentrically with the trochoidal bore. With this crank mechanism the honing head experiences the crank movement, that is, it rotates on its axis and is subjected to the planetary movement with a predetermined eccentricity. Thus, the honing head can conduct the trochoidal movement relative to the workpiece.

In the conventional honing machine, however, the dimensional and spacial relationships of the gear mechanism and the crank mechanism should meet strictly severe requirements. As a result, correct centering of the mechanisms as well as correct production of the parts of the mechanisms is a quite difficult problem. Moreover, the obtainable trochoidal form can scarcely be varied. It can also be said that the speed of rotation of the honing head is inevitably limited to a relatively low level, with a degraded production performance.

It is, therefore, an object of the present invention to provide a honing machine which is free from any of the above drawbacks.

Another object of the invention is to provide a honing machine in which a crank movement between the honing head and the workpiece is eliminated to allow a high speed of rotation of the honing head.

Still another object of the invention is to provide a honing machine in which eccentricity between the centers of the honing head and the workpiece is controlled over a wide range.

A further object is to provide a honing machine in which the bias pressure of the stone slips against the workpiece inner surface is periodically reduced or increased in response to the angular positions of the slips relative to the inner surface.

A further object is to provide a honing machine in which the honing head can pneumatically damp or absorb such a shock, if any, as is experienced at the contact interface between the workpiece inner surface and the stone slips.

Other objects and advantages of the present invention will now be described with reference to the accompanying drawings, in which.

Figure 1:
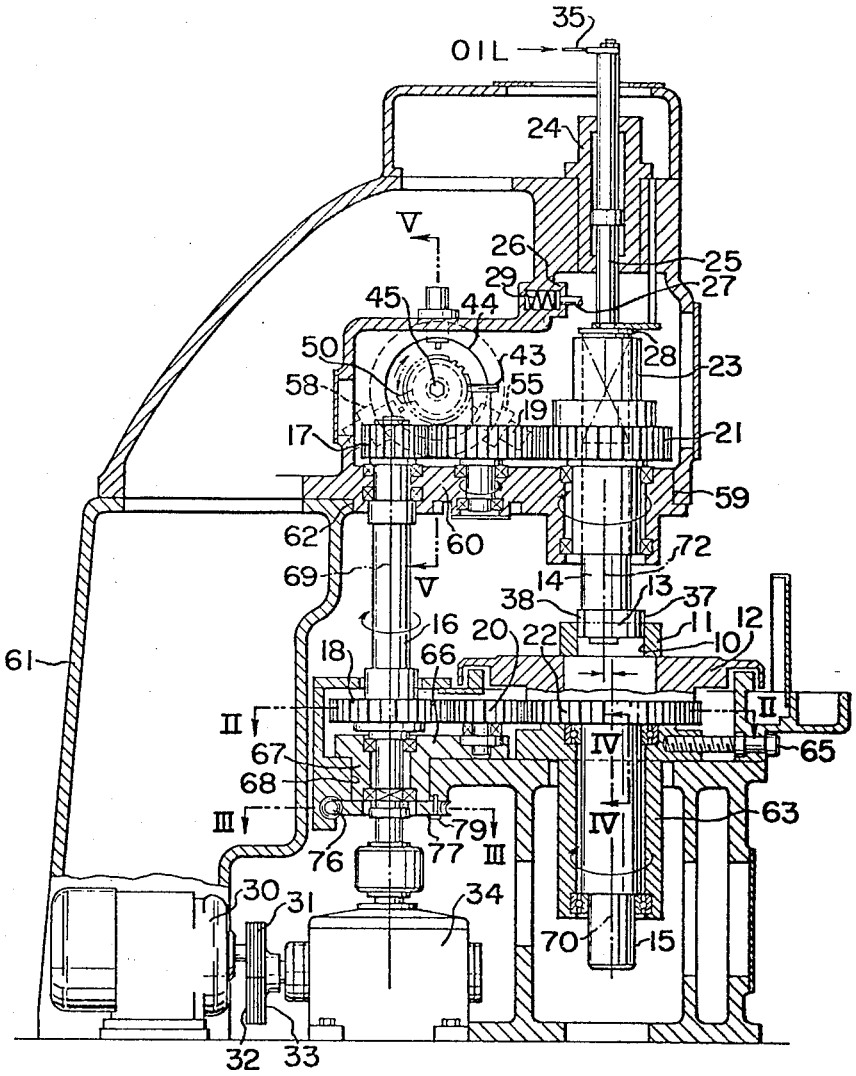
FIG. 1 is a partially cross-sectional view showing a honing machine according to the present invention.

Referring now to FIG. 1, a honing machine according to the invention generally includes a main body 61 which bears drive shaft 16 rotatably, preferably, about its vertical axis. This drive shaft 16 is provided at its both ends with two spur gears 17, 18 which are respectively named the head drive gear and table drive gear. For effecting honing of the inner wall surface 10, for instance, of a trochoidal bore of workpiece 11 such as a rotor of a rotary engine, there is provided in the honing machine a honing head 13 which in turn is provided on its periphery with a plurality of stone slips 36 to 38. These stone slips 36 to 38 are biased outwardly into sliding contact with the inner wall surface 10. To the honing head 13 is coaxially secured honing-head shaft 14 which may preferably be received in cylindrical shaft 23 having its axis arranged in parallel with the axis of the drive shaft 16. Within this cylindrical shaft 23 is axially movable the honing-head shaft 14 so as to bring the honing head 13 into and out of the trochoidal bore of the workpiece 11. However, the honing-head shaft is designed to forcibly rotate integrally with the cylindrical shaft 23. This cylindrical shaft 23 is provided with an integral head gear 21 which is of the spur type. Between this head gear 21 and the head drive gear 17 of the drive shaft 16 is interposed the first intermediate idle gear 19 which meshes with the same for transmitting rotational motion from the drive shaft 16 to the honing head 13 by way of the cylindrical shaft 23 and the honing-head shaft 14.

The workpiece 11 is securely held on a machine table 12 in position in a known manner. To this machine table 12 is coaxially secured a table shaft 15 which is provided with an integral spur gear 22 and which has its axis arranged with an eccentricity *e* from the axis of the honing-head shaft 14 but in parallel with the axis of drive shaft 16. A second intermediate idle gear 20 is also provided to mesh with the table shaft gear 22 and with the table drive gear 18 of the drive shaft 16 so as to transmit rotational motion from the drive shaft 16 to the machine table 12 through the table shaft 15.

With these construction arrangements, the direction of rotation of the honing head 13 is designed to be identical with that of the machine table 12. Moreover, the ratio of speed of rotation of the honing head 13 to that of the machine table 12 is preset to have a suitable value, for example, of 2 : 3. Thus, the honing head 13 can move relative to the machine table 12 in a fashion to draw a desired trochoidal curve so as to finish the inner trochoidal surface of the workpiece 11.

In the present honing machine is also provided head-position control means which includes head-position control cylinder 24 rotatably connected to the honing-head shaft 14 through its piston rod 25. A working fluid such as oil under pressure is supplied to this control cylinder 24 so that the piston rod 25 and accordingly the honing-head shaft 14 is moved up and down along the axis thereof. In this way, the honing head 13 can move between the two axial positions, that is, at its lower position it is in sliding contact with the inner trochoidal surface of the workpiece 11, while at the upper position it is apart from the workpiece 11 in stand-by position for the subsequent honing operation. In order to hold the honing head 13 at this stand-by position, locking means may preferably be provided which includes locking cylinder 26 with piston rod 27 acting as a locking arm. This piston rod 27 is normally biased by a compression spring 29 toward the axis of the honing-head shaft 14. At an upper end of the shaft 14 is formed a radial projection 28 which can be in locking engagement with the extending end of the piston rod 27. As the honing head 13 is lifted by the action of the pressurized oil in the control cylinder 24, therefore, the projection 28 first abuts and subsequently presses the end of the piston rod 27 against the action of the compression spring 29 into the locking engagement therewith. The release of this engagement can be made manually or with use of suitable means.

As shown in the lower left-hand side portion of FIG. 1, the rotational motion of the drive shaft 16 is performed by a suitable prime mover such as a DC motor 30. This DC motor is of the reversible type and is provided with pulley 31 on its shaft (not numbered). For transmitting the rotational motion, an endless belt 32 is carried by the pulley 31 and a pulley 33 of a reduction gear apparatus 34. Thus, the rotational motion of the DC motor 30 reversing back and forth at a predetermined time interval is reduced at the apparatus 34 and is transmitted to the drive shaft 16.

When, in operation, oil under pressure is introduced into the locking cylinder 26 with its piston rod 27 remaining in locking engagement with the projection 28, then the piston rod 27 is moved leftwardly of the drawing against the biasing force of the spring 29 to thereby release the particular locking engagement. In the meantime the head-position control cylinder 24 is also supplied with oil under pressure through a suitable oil conduit (not shown), so that the honing head 13 is lowered into the trochoidal bore of the workpiece 11. It is preferable here that the supply of the pressurized oil to the cylinder 24 is so controlled as to cause the head 13 to vertically traverse in the trochoidal bore with a predetermined stroke. For effecting fine honing of the inner wall surface of the bore, bias-pressure control means is provided in the head proper, and includes bias-pressure control cylinders 39 to 41 respectively for the stone slips 36 to 38. The bias pressure of the stone slips 36 to 38 toward the inner trochoidal surface is controlled by supplying oil at a predetermined pressure level to the control cylinders 39 to 41 from a pressurized liquid source (not shown) through an oil inlet conduit 35 and oil passage (not shown) in the piston rod 25 and the honing-head shaft 14. The detailed explanation of the operation of this bias pressure control will be made hereinafter with reference to FIGS. 5 and 6.

With the honing head 13 being rotated, in this instance, the stone slips 36 to 38 continue to hone the inner wall surface 10 until a finished surface of desired accuracy or smoothness is obtained. During the honing operation, the rotation of the head 13 is directed back and forth at a predetermined time interval. At the instant when the completion of the honing operation is detected in terms of, for example, friction with the inner surface 10, the oil pressure in the control cylinders 39 to 41 is released in the opposite direction, namely, through the not-shown oil passage and the oil inlet conduit 35, so that the stone slips 36 to 38 contract radially inwardly with their outer ends spaced from the inner surface 10. After this operation, the honing head 13 is lifted by introducing oil under pressure into the lower chamber (not numbered) of the control cylinder 24 through an oil passage (not shown). As the lifting operation of the head 13 proceeds, the pressure in the locking cylinder 26 is released to allow the compression spring 29 to push the piston rod 27 outwardly into the locking engagement with the projection 28 of the honing-head shaft 14 for stand-by status for the next honing operation. This locking operation may be accompanied by deenergizing the DC motor 30, thus finishing one cycle of honing operation.

In order to obtain a variety of accurately finished trochoidal bores of desired form, eccentricity control means should also be provided in the honing machine of the present invention, with the prerequisite that the workpiece 11 is accurately fastened to the machine table 12. For this purpose, the eccentricity control means should provide smooth and effective meshing engagements between the spur gears 17 to 22 without adversely affecting the eccentricity *e* between the center 72 of the honing head 13 and the center 70 of the machine table 12, as best shown in FIG. 2.

Figure 2:
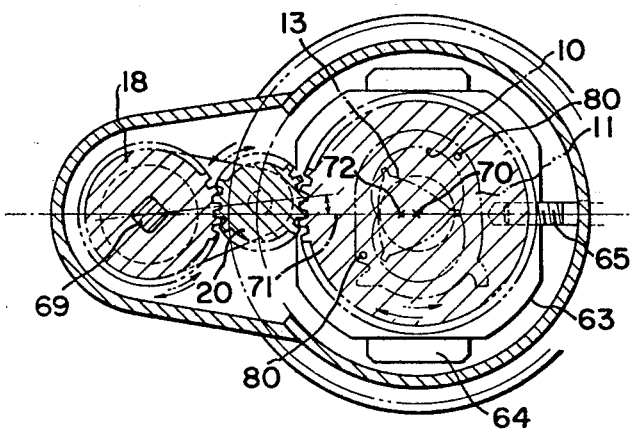
FIG. 2 is a section taken along the line II—II of FIG. 1.
Figure 3:
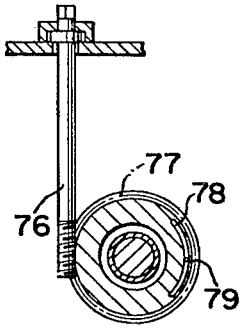
FIG. 3 is a section taken along the line III—III of FIG. 1.
Figure 4:
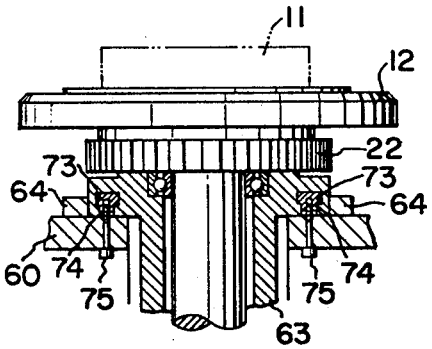
FIG. 4 is a partial section taken along the line IV—IV of FIG. 1.

Turning now to FIGS. 2 to 4, a head support 59 bearing the honing head 13 and the gears 19, 21 is, after its upper annular support portion 60 has been rotatably fitted into an upper support bore 62 of the main body 61, fastened to the body 61 by suitable means such as a fastening bolt (not shown). On the other hand, a table support 63 is also provided which is interposed between guides 64 for guiding the support 63 toward and away from the drive shaft 16. The supporting position of the table support 63, and accordingly the eccentricity *e* is thus controlled by the eccentricity control means or bolt 65, as is easily understood with reference to FIGS. 1 and 4.

Apart from the eccentricity control as described above, the clearance between a pair of gears, such as, the head drive gear 17 and the first idle gear 19 is also adjusted to obtain smooth and effective meshing engagements between respective pairs of the spur gears 17 to 22, which will be described with respect to FIGS. 1 to 3. More specifically, the lower portion of the drive shaft 16 is born in lower support bore 68 of the main body 61 by way of a cylindrical support 67 of a rocking arm 66 which in turn bears the second idle gear 20.

With the construction arrangement as above, when it is intended to finish a desired trochoidal bore of the workpiece 11 by honing the inner surface 10 thereof with use of the present honing machine, the head support 59 is secured to the main body 61 by a suitable fastening bolt (not shown), such that the center 72 of the honing head 13 correctly lies on line 71 which is common to the center 69 of the drive shaft 16 and to the center 70 of the machine table 12, as is illustrated in FIG. 2. Then, the particular eccentricity $e$ is finely adjusted by turning the control bolt 65 so as to control the supporting position of the machine table 12. After completion of this eccentricity control operation, the machine table 12 is firmly secured to the main body 61 by fastening a T-shaped thrust block 74 mounted in T-shaped groove 73 which runs in the direction of guidance of the table 12. The clearance between the gears 18, 22 of the table side and the second idle gear 20 is, on the other hand, adjusted by turning clearance control worm 76 and by the following turning of worm gear 77, the latter being integral with the rocking arm 66, as best shown in FIG. 3. Thus, the idle gear 20 is held at an adjusted position together with the worm gear 77 by the action of fastening bolt 79 which is screwed into the main body 61 through arcuate slit 78 formed in the worm gear 77, as shown.

The accurate positioning of the workpiece 11 on the machine table 12 can be carried out in the conventional manner. For this purpose, for example, a suitable number of positioning pins 80 may be formed on the table 12 and are fitted into corresponding positioning bores formed in the lower surface of the workpiece 11.

Figure 6:
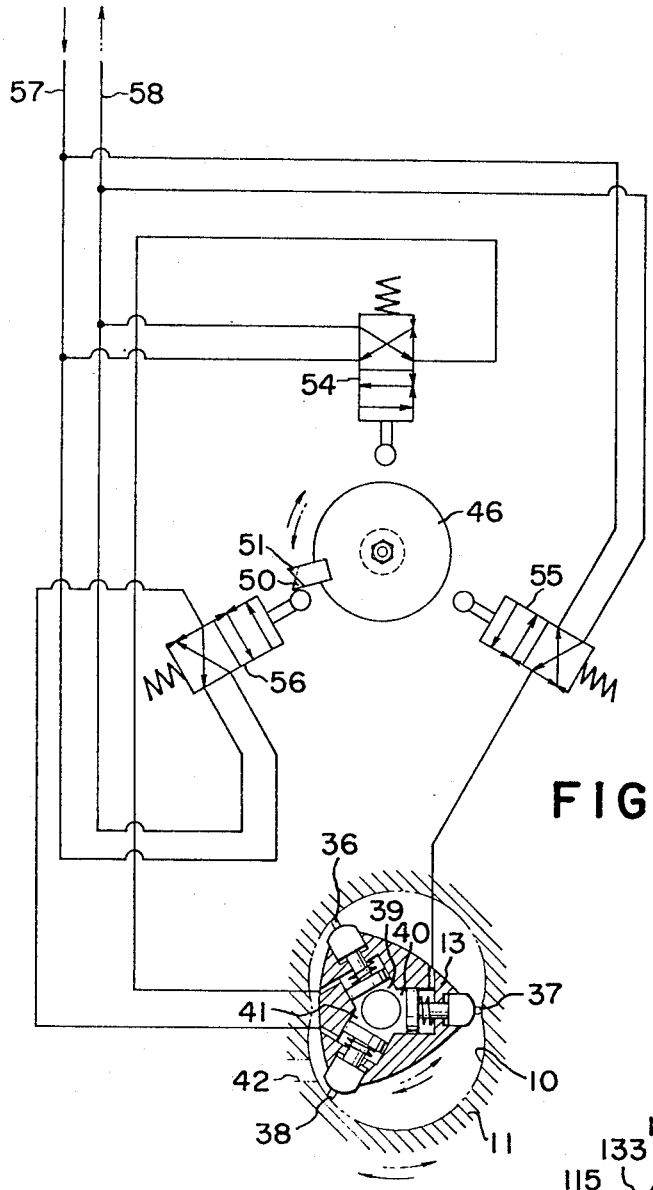
FIG. 6 is a diagrammatical view showing the working pressure control system for use in the honing machine of FIG. 1.

In the discussion made hereinbefore, the workpiece to be honed is not so explicitly specified, but the present honing machine is originally intended to be applied to the finishing of a two-lobed rotor housing of a rotary engine having its exhaust port formed on the inner periphery thereof. The exhaust port as indicated at numeral 42 in FIG. 6 is relatively large, so that if the nominal bias pressure toward the inner trochoidal surface should be preset uniform throughout the surface 10 including the exhaust port 42, the innermost periphery of the port 42 would be damaged or excessively finished to invite undesirable engine performance degradation due to premature leakage of combustion gases through the excessively finished portion. In order to be free from this locally excessive finishing, therefore, net bias pressure to be applied to a unit area of the inner surface 10 should be constant even at the reduced-area portion with the exhaust port 42. In other words, the nominal or total bias pressure should be reduced at the reduced-area in an amount to correspond to the reduction in the effective area.

Figure 5:
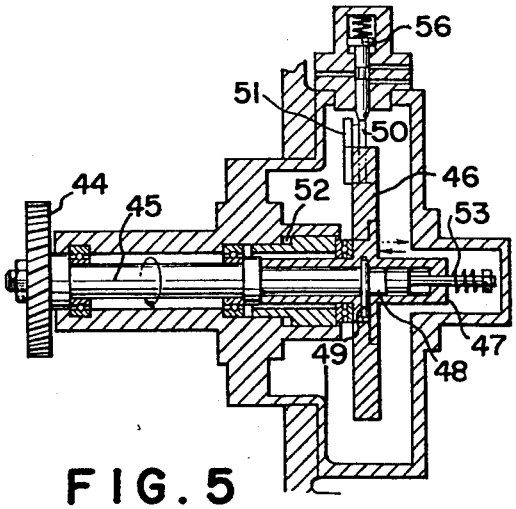
FIG. 5 is also a partial section taken along the line V—V of FIG. 1.

Referring to FIGS. 1, 5 and 6, there is also provided in the honing machine of the invention detecting means which is responsive to the rotational motion of the honing head 13 relative to the machine 12 so as to detect the angular position of the exhaust port 42. This detection is performed in terms of the angular positions of the stone slips 36 to 38 relative to the two-lobed inner wall 10 of the workpiece 11. The detecting means includes detecting gear 43 which may be connected to any of the gears 17 to 22 for the detection. But, the detecting gear 43 is integrally connected to the shaft of the first idle gear 19 and meshes with a follower or driven gear 44, as shown in FIGS. 1 and 5. The tooth ratio of the gear 19 to the gear 44 is preset such that the latter can rotate at a predetermined speed, for instance, at the relative speed between the honing head 13 and the table 12, that is, with a speed ratio ½ to the head 13 (or with a speed ratio ⅓ to the table 12). The driven gear 44 is secured to a shaft 45, the other end of which is inserted into cylindrical shaft 47 provided with an integral disc 46. In the shaft 45 is formed a bore 48 into which a lock pin 49 integral with the cylindrical shaft 47 is fitted to effect a joint between the two shafts 45 and 47. At a suitable peripheral position of the disc 46 is provided dogs 50, 51 which are spaced at a distance from each other in the axial direction of the shaft 45. These dogs 50, 51 together with the disc 46 can move axially of the shaft 45 by the associated actions of both a change-over cylinder 52 and a compression spring 53.

Turning especially to FIG. 6, the honing head 13 is, in this instance, of generally triangular shape having its stone slips 36 to 38 arranged at its apexes apart from each other by an angle of 120°. Accordingly, change-over valves 54 to 56 for controlling the bias-pressure control cylinders 39 to 41 are also angularly spaced from each other by 120° around the dogs 50 and 51. The change-over valves 54 to 56 are, as shown, provided between the bias-pressure control cylinders 39 to 41 and a pressurized liquid source (not shown), and are responsive to the detected relative angular positions of the respective stone slips 36 to 38 so as to change the respective communications of the fluid source with the control valves 39 to 41. By the change-over operations of the valves 54 to 56 associated with the rotating dogs 51, 52, the working liquid or oil under a regulated pressure is introduced from the not-shown liquid source into the control valves 39 to 41 through an oil inlet conduit 57. The above change-over operations are in synchronism with the relative rotation of the honing head 13, so that the bias pressure against the inner surface 10 of the workpiece 11 is controlled to be uniform in its net level even when one of the slips 36 to 38 passes on the exhaust port 42. The oil in the control valves 39 to 41 is also periodically released by way of an oil outlet conduit 58. The description of the inside construction of the honing head 13 and the control cylinders 39 to 41 will be made in more detail with reference to FIGS. 7 and 8.

Although the bias-pressure control cylinders 39 to 41 and the change-over valves 54 to 56 are schematically shown in FIG. 6, the interactions will now be described in the following manner. The valves 54 to 56 are the so-called two-position valves which are normally biased radially inwardly by suitable biasing means such as a compression spring (not numbered) and which have an acting rod (not numbered) extending radially inwardly to be engageable with either of the dogs 50, 51. The outer ends of the dogs 50, 51 are inclined with respect to the circumference thereof, such that the inclined ends have a negative attack angle toward the acting rod. Thus, when the disc 46 rotates in the direction of the solid arrow, the axial displacement of the disc 46 takes place to have the dog 50 engage with the acting rod. When the valve 56 is moved radially outwardly against the action of the compression spring, as easily understood from FIG. 6, then oil passages in the valves shift from the outer block to the inner block. At this instant, the control cylinder 41 is supplied with the oil under the regulated pressure through the oil conduit 57. The oil is then introduced into the outer chamber (not numbered) of the cylinder 41 to move its piston (not numbered) radially inwardly together with the stone slip 38, thereby reducing the bias pressure against the workpiece inner wall by a predetermined amount. As a result, the bias pressure control is periodically effected when the stone slips 36 to 38 are in sliding contact with the inner wall portion formed with the exhaust port. This will be understood by referring to FIG. 6, in which the stone slip 38 is approaching the exhaust port 42 when the acting rod is just prior to abutment with the dog. This interaction of the change-over valve 56 with the control cylinder 41 is also applied to the pair of the valve 54 and cylinder 39, and to the pair of the valve 55 and cylinder 40, in the sequence of rotation of the disc 46.

As has been described before, the rotation of the DC motor 30 and accordingly of the disc 46 and honing head 13 changes its direction at a predetermined time interval. Therefore, in the case when the disc 46 rotates in the direction of the dotted arrow, the axial position of the disc is shifted to have the dog 50 engage with the acting rods of the valves 54 to 56, maintaining the negative attack angle relationship. Other interactions of the valves and cylinders under consideration are similar to those of the case in which the rotation is directed in the solid arrow, and, as such, the repeated explanation thereof is omitted here.

Figure 8:
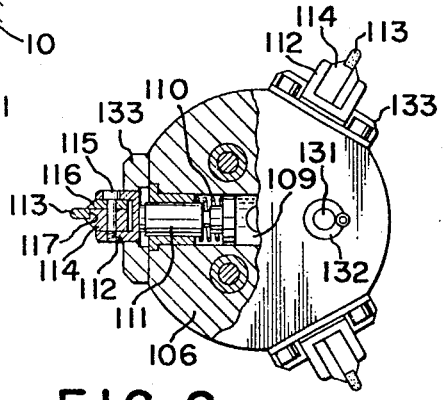
FIG. 8 is a partially cut-away plan view of the honing head portion of FIG. 7.
Figure 7:
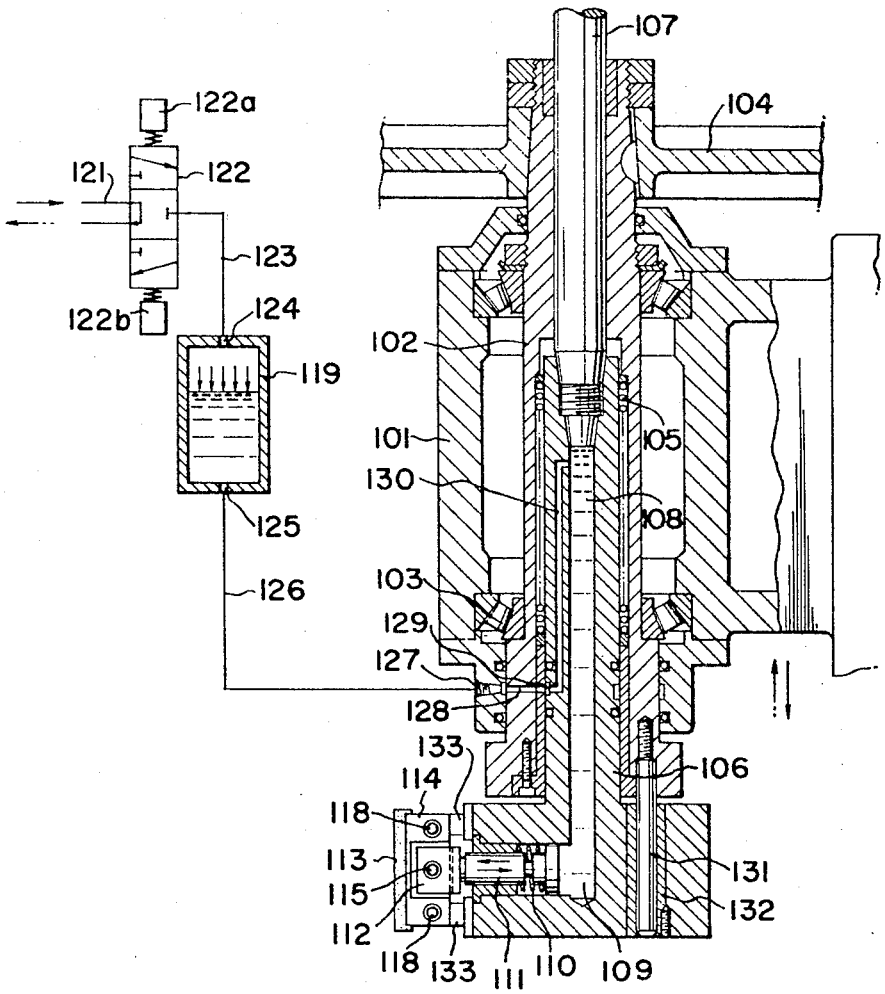
FIG. 7 is a generally cross-sectional view showing a honing head portion for use with the honing machine of FIG. 1.

Turning now to FIGS. 7 and 8, the hoining head to be discussed is slightly modified to have an additional feature, so that the constituent elements thereof will be renumbered. Referring especially to FIG. 7, the honing-head body 101 is designed to be vertically moved by such a suitable elevating apparatus (not shown) as described previously. On this body 101 is rotatably born through bearings 103 a spindle 102 which is supplied with rotational motion from a gear or pulley 104 secured thereto. Into this hollow spindle 102 is rotatably inserted a honing-head proper 106, with a bearing 105 interposed inbetween. Into the upper end of the head proper 106 is screwed a vibration rod 107 which is vertically vibrated by suitable vibration means (not shown). With these arrangements the vertical vibrations are applied to the head proper 106 by way of the vibration rod 107 when in the honing operation of the honing machine. The head proper 106 is formed at its center with a cylindrical oil-pressure chamber 108 which communicates at its lower end with the bias-pressure control cylinders 109 equi-angularly spaced from each other and having their axis arranged radially of the head proper 106. In the control cylinders 109, respectively, is slidably received a piston rod 111 which is normally biased radially inwardly toward the oil-pressure chamber 108 by a compression spring 110. The extending end of the piston rod 111 is provided with a U-shaped slip support 112 to which a slip holder 114 carrying the stone slip 113 is swingably connected by means of a rocking pin 115. As better shown in FIG. 8, the stone slip 113 is held in position in an axial groove 117 formed between the slip holder 114 and thrust plate 116. The fastening of the slip 113 is carried out by turning a fastening bolt 118, as shown.

With reference to the upper left-hand corner of FIG. 7, reference numberal 119 indicates a damping reservoir which stores therein working fluid or oil under a pressure regulated through air. The damping reservoir 119 is formed at its upper portion with an air intlet port 124 through which pressurized air is introduced into the reservoir 119 from a pressurized-air source such as an air compressor (not shown) via an air conduit 121, change-over valve 122 and air conduit 123 in that order. The upper chamber portion of the reservoir 119 is filled with the thus introduced pressurized air, while the lower portion with the pressurized oil. This oil is to be supplied to the oil-pressure chamber 108 from an air outlet port 125 formed at the lower portion of the reservoir 119. The oil passage for communicating the port 125 with the chamber 108 is composed of an oil inlet conduit 126, an oil port 127 formed in the head body 101, an oil passage 128 formed in the spindle 102, an annular groove 129 in the head proper 106, and an oil passage 130 in the head proper 106.

When, in operation, an air intake solenoid **122*a* is energized, the change-over valve 122 is moved downwardly of FIG. 7 to provide communication between the air conduits 121 and 123. As a result, the oil pressure in the damping reservoir 119 is increased to have a predetermined level. This boosted oil is then introduced into the oil-pressure chamber through the above-described oil passage. With the pressure in the chamber 108 increases, the piston rod 111 is displaced radially outwardly of the head proper 106 against the biasing action of the spring 110 to press the stop slip 113 onto the workpiece inner periphery with a predetermined pressure level. According to a predetermined operational sequence, the air-intake solenoid 122*a* is deenergized with the concurrent energization of an air-exhaust solenoid 122*b*. At this particular instant, the change-over valve 122 is lifted to release the boosted oil pressure in the chamber 108 by way of an air conduit 134**.

The energizing operations of the two solenoids **122*a*, 122*b* may preferably be carried out in synchronism with and in response to the relative angular positions of the stone slips 113 with respect to the machine table, as is the case in which the honing head under consideration is applied to the honing machine as has been described in detail with reference to FIGS. 1 to 6. In this way, the bias pressure of the stone slips 113 against the inner wall surface 10 of the workpiece 11 is also reduced by an amount sufficient to prevent excessive honing of the workpiece portion at which a bore or the exhaust port 42 is formed, at the instant when one of the slips 113 runs over the port 42, as has been explained with reference especially to FIG. 6**.

As is apparent from the above description, the modified honing head of FIGS. 7 and 8 employs the damping reservoir 119 in which air and oil are confined under pressure. Air is known to be more compressible than oil, so that the coexistance of the two in the reservoir 119 will highly damp or absorb such a shock, if any, as is often experienced at the contact interface between the workpiece inner periphery and the stone slips 113.

Reverting to FIG. 7, the connection of the honing-head proper 106 to the spindle 102 is performed in a manner that is received vertically slidably in but is made to rotate integrally with the latter. For this purpose, guide tube 132 is fastened to the head proper 106 at its radially outer portion by a suitable screw (not numbered). Into the central bore of the guide tube 132 is slidably inserted a guide pin 131 which is screwed into the spindle 102. Thus, in operation, the head proper 106 can rotate together with the spindle 102 by the rotational motion transmitted through the gear 104. At the same time, the sliding contact between the guide tube 132 and the guide pin 131 will permit the head proper 106 to vertically move with a considerable stroke, when vertical positioning of the honing head is effected into and out of the workpiece bore, and with a limited amplitude when vertical oscillations are applied to the head proper 106 through the vibration rod 107, both independently of the spindle 102.

It should be appreciated here that the honing machine according to the present invention is featured by finishing a complicated trochoidal bore of a rotor housing of a rotary engine at a high speed.

According to the invention, eccentricity between the centers of the honing head and the workpiece, which is known to affect the resultant trochoidal form, can be adjusted to make the honing head follow smoothly and finely the obtained trochoidal inner surface.

According to the invention, moreover, the bias pressure of the stone slips against the workpiece inner surface can be periodically reduced and increased in response to the angular positions of the slips, so that the bias pressure is uniformly obtained even when the slips face the reduced portion with a hole such as an exhaust port of the rotor housing.

Still moreover, shocks as experienced at the contact interfaces between the workpiece inner surface and the acting surfaces of the stone slips are pneumatically damped or absorbed to obviate damage of the workpiece inner surface being finished.

What is claimed is:

1. A honing machine for finishing a trochoidal bore of a workpiece by honing the inner wall surface thereof having an opening portion, comprising:

a. a honing head provided on its periphery with a honing stone which is biased outwardly into sliding contact with the inner wall surface of the workpiece for honing the same when rotatably received within the trochoidal bore, b. a honing head shaft coaxially secured to said honing head, c. means for rotating the honing head shaft, d. a machine table for holding the workpiece in position, e. means for controlling the position of the honing head and the machine table to draw a preset trochoid curve, f. detecting means for detecting when the honing stone is on the opening portion, g. bias-pressure control means for controlling the bias pressure of said honing stone toward said inner wall surface, h. a pressurized fluid source communicating with said bias pressure control means for supplying thereto a liquid under pressure, and i. honing control means hydraulically connected to said pressurized fluid source and responsive to said detecting means for decreasing the bias pressure of said honing stone toward said inner wall surface when said honing stone is on the opening portion of the inner wall surface.

2. A honing machine as claimed in claim 1, further comprising a table shaft coaxially secured to said machine table and provided with an integral gear, said table shaft having its axis arranged eccentrically of the axis of said honing-head shaft, and a drive shaft having its axis arranged in parallel with the axes of said table shaft and said honing-head shaft and provided with two integral gears, one of the gears of the drive shaft meshing with a gear of the honing head shaft and the other thereof meshing with a gear of the table shaft for transmitting rotational motion from said drive shaft, wherein the direction of rotation of said honing head is the same as that of the machine table, and the ratio of speed of rotation of the former to that of the latter is predetermined, so that the former moves relative to the latter in a manner to draw a preset trochoidal curve, and said detecting means is responsive to the rotational motion of said honing head relative to said machine table.

3. A honing machine as claimed in claim 1, wherein said honing head comprises a piston and a cylinder for the honing stone, and said bias-pressure control means comprises means for supplying the bias pressure to said piston to urge the honing stone toward said inner wall surface, and said honing control means comprises means for supplying a fluid pressure to said piston to decrease the bias pressure toward the inner wall surface by the detecting means when the honing stone is on said opening portion.

4. A honing machine as claimed in claim 1, wherein said honing head is provided on its periphery with three honing stone arranged at an angle of 120° to one another.

5. A honing machine as claimed in claim 4, wherein said honing head comprises a piston and a cylinder for each honing stone, and said bias-pressure control means comprises means for supplying the bias pressure to all pistons to urge all honing stones toward said inner wall surface, and said honing control means comprises means for supplying a fluid pressure to each piston to decrease the bias pressure toward the inner wall surface, whereby when the honing stone is on the opening portion, the fluid pressure to decrease the bias pressure toward the inner wall surface is supplied only to the piston for the honing stone on the opening portion.

6. A honing machine as claimed in claim 2, wherein the rotational ratio of the machine table to the honing head is preset to a value of N+1:N, and said honing control means comprises rotating means, the rotational ratio of said rotating means to the machine table being preset to a value of 1:N+1, and said detecting means detecting the honing stone being on the opening portion by the rotating means.

* * * * *